US010267516B2

(12) United States Patent
Shurtleff et al.

(10) Patent No.: US 10,267,516 B2
(45) Date of Patent: Apr. 23, 2019

(54) METHOD FOR CONTROLLING THE BTU CONTENT OF A FLARE GAS

(71) Applicant: Airgas, Inc., Radnor, PA (US)

(72) Inventors: James A. Shurtleff, Kingwood, TX (US); Paul A. Bielamowicz, Seabrook, TX (US); Charles A. Baselice, Jr., West Chester, PA (US)

(73) Assignee: Airgas, Inc., Radnor, PA (US)

( * ) Notice: Subject to any disclaimer, the term of this patent is extended or adjusted under 35 U.S.C. 154(b) by 6 days.

(21) Appl. No.: 15/637,639

(22) Filed: Jun. 29, 2017

(65) Prior Publication Data

US 2019/0003707 A1 Jan. 3, 2019

(51) Int. Cl.

| | |
|---|---|
| ***F23D 14/00*** | (2006.01) |
| ***F23G 7/06*** | (2006.01) |
| ***F23G 5/50*** | (2006.01) |
| ***F23G 7/08*** | (2006.01) |

(52) U.S. Cl.

CPC ..... *F23G 7/065* (2013.01); *F23G 5/50* (2013.01); *F23G 7/085* (2013.01); *F23G 2207/40* (2013.01); *F23G 2900/55011* (2013.01)

(58) Field of Classification Search

CPC ..... F23F 7/065; F23F 5/50; F23G 7/085
USPC ..... 431/5, 202
See application file for complete search history.

(56) References Cited

U.S. PATENT DOCUMENTS

| | | | | |
|---|---|---|---|---|
| 5,971,744 | A * | 10/1999 | Eaton | F23G 7/08 431/202 |
| 2012/0015308 | A1* | 1/2012 | Hong | F23G 5/50 431/5 |
| 2017/0370579 | A1* | 12/2017 | Johnson | F23N 1/002 |

OTHER PUBLICATIONS

GE., "Path to Compliance Refinery Sector Rule 63.673 Compliance". GE Title of job number Dec. 13, 2016.*

* cited by examiner

*Primary Examiner* — Vivek K Shirsat
(74) *Attorney, Agent, or Firm* — Elwood L. Haynes

(57) ABSTRACT

A method for controlling the Btu content of a flare gas to combusted in a flare stack comprising a flare tip is provided. The method includes, introducing a first gas stream including nitrogen to be flared, the first gas stream having an initial Btu content, providing a supplemental fuel gas stream, and combining the first gas stream with the supplemental fuel gas stream, thereby obtaining a flare gas stream having a final Btu content measured at the flare tip.

17 Claims, 1 Drawing Sheet

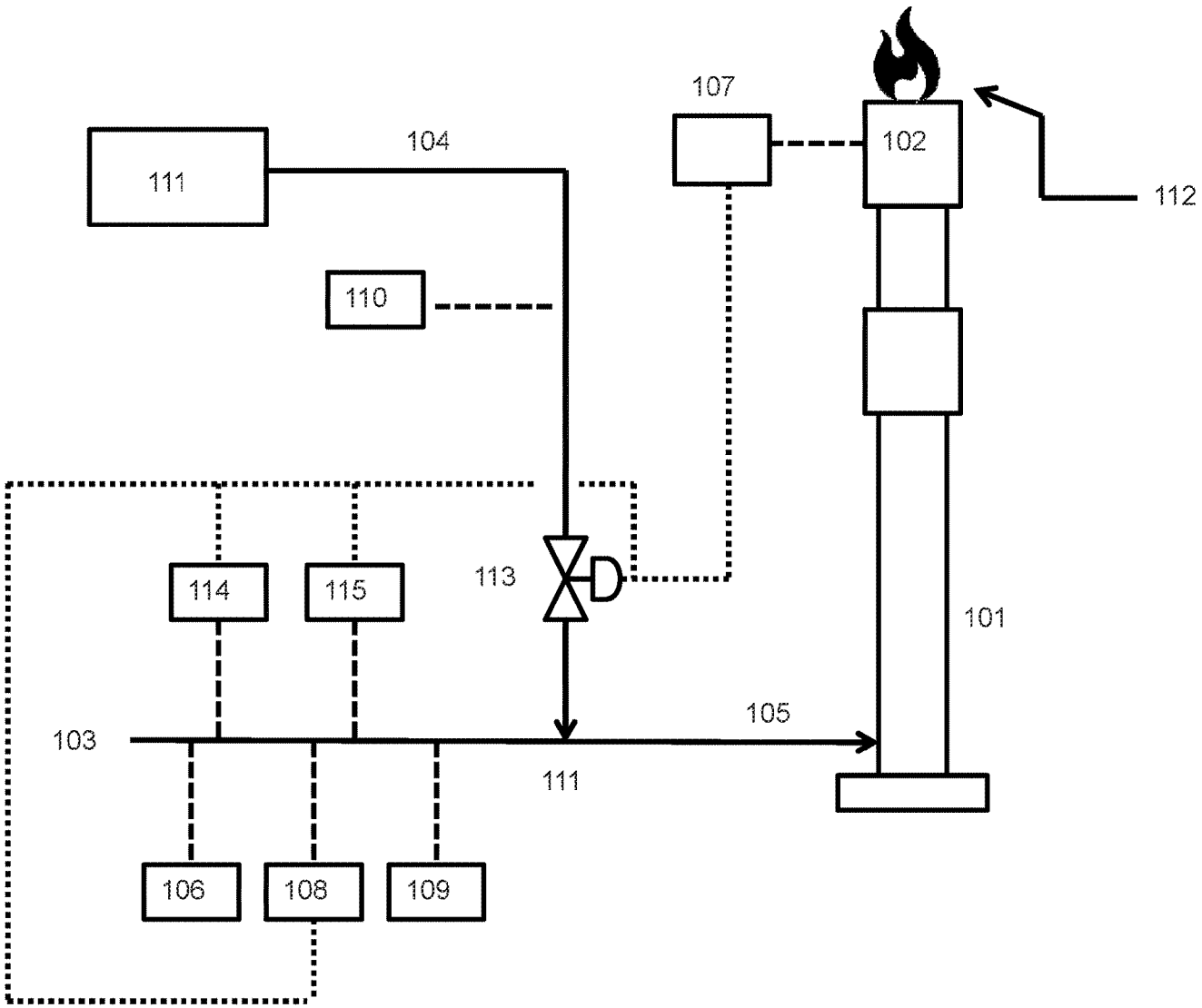
112
102
107
101
105
104
111
110
113
115
114
109
108
106
103

METHOD FOR CONTROLLING THE BTU CONTENT OF A FLARE GAS

BACKGROUND

Flares are regularly used to combust hydrocarbons and hazardous air pollutants in refineries, chemical plants and other oil and gas related operations. Certain of these facilities are required to meet minimum BTU Net Heating Values (NHVs) for gas streams fed to flares in order to assure combustion of hydrocarbons and hazardous air pollutants (HAPs). NHV requirements may apply to the gas in the feed line or at the flare tip depending on applicable rules for the specific facility type.

As an example, new rules applicable as part of the EPA's revised Refinery Sector Rule (RSR) eliminate previous compliance exemptions for process start up, shut down and malfunction ("SSM") events which can all result in substantially increased gas flow to flares. Under the revised new rules, emergency flaring, flow from pressure relief device (PRD) venting, sulfur recovery plants catalytic cracking units and other processes must now meet new NHV requirements.

Most, but not all, PRD release and malfunction events will release hydrocarbon rich streams which are high in BTU NHV and inherently compliant with the rule. Conversely, nitrogen is regularly used to purge hydrocarbons and hazardous air pollutants from process equipment, feed lines, storage tanks and other areas in oil and gas facilities. These nitrogen purge streams can be very high flow and largely composed of Nitrogen which has a NHV of Zero (0) BTUs. Nitrogen dilution of gas streams will cause them to fall below regulatory NHVs and cause a facility to be out of compliance with regulatory standards.

Facilities will regularly need to feed higher BTU supplemental fuel gas to flare streams to increase the stream NHV in order to stay in compliance. Similar situations exist for chemical plants and other operations who must meet requirements outlined in other rules.

There are several source options for various supplemental fuel gases within plant operations including natural gas supplied by pipeline, process generated products such as hydrogen, propane, propylene or butane and light ends fuel gas produced from distillation and other processes. And, some facilities have already made needed connections to their flare streams to meet requirements for most or all cases.

Other facilities, though, are faced with technical and logistics challenges related to these requirements including the following:

- The expense of running connections within the facilities from fuel gas sources to flare feed lines. One example noted that the flares are on one corner of the site and the source gas is on the opposite corner with a resultant project cost that is too high to consider.
- Restricted and/or insufficient flow from natural gas utilities. Restricted flow could be a result of other critical users on a line that would be adversely affected by a plant pulling very high volumes of gas
- An inadequate supply of surplus fuel gas from process sources may also prove to be a problem. For example a product that might otherwise be available is required to feed new or bottle-necked plant processes.
- Pipeline supplied natural gas exists and is possibly already connected, but the available volume is inadequate to meet highest flow, and
- Inavailability of normal supplemental fuel gas supply due to partial or overall plant outage.

SUMMARY

A method for controlling the Btu content of a flare gas to combusted in a flare stack comprising a flare tip is provided. The method includes, introducing a first gas stream comprising nitrogen to be flared, the first gas stream comprising an initial Btu content, providing a supplemental fuel gas stream, and combining the first gas stream with the supplemental fuel gas stream, thereby obtaining a flare gas stream comprising a final Btu content measured at the flare tip.

The supplemental fuel gas flow is initiated when the initial Btu content falls below a predetermined minimum net heating value measured at the flare tip. The supplemental fuel gas flow is terminated when at least one of the following conditions has been met by the first gas stream: the hazardous air pollutants (HAP) level is less than 20 ppm, the pressure is below 5 psig, or the lower explosive limit (LEL) is less than 10%.

In a first operating mode the first gas stream has a first flow rate, wherein the first flow rate is measured; the supplemental fuel gas has a second flow rate, wherein the second flow rate is measured; and wherein the ratio of the second flow rate to the first flow rate is maintained at a predetermined value, thereby maintaining the final Btu content at or above a minimum net heating value measured at the flare tip.

In a second operating mode the first gas stream has a first flow rate, wherein the first flow rate and the initial Btu content are measured; the supplemental fuel gas has a second flow rate, wherein the second flow rate is measured and the final Btu content is measured at the flare tip; and wherein the second flow rate is adjusted to maintain the final Btu content at or above a minimum net heating value at the flare tip.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein:

FIG. 1 is a schematic representation in accordance with one embodiment of the present invention.

DESCRIPTION OF PREFERRED EMBODIMENTS

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure

ELEMENT NUMBERS

101=Flare Stack
102=Flare Tip
103=First Gas Stream
104=Supplemental Fuel Gas Stream
105=Flare Gas Stream
106=Btu Content of First Gas Stream
107=Btu Content at Flare Tip
108=First Gas Stream Pressure
109=First Gas Stream Flow Rate
110=Supplemental Fuel Gas Stream Flow Rate
111=Source of Supplemental Fuel Gas Stream
112=Flare Assist Fluid
113=Supplemental Fuel Gas Stream Valve
114=HAP Measurement of First Gas Stream
115=LEL Measurement of First Gas Stream

DEFINITIONS

As used herein, Lower Explosive Limit (LEL) is defined as the lowest concentration of a gas or a vapor in air that is capable of producing a flash of fire in the presence of an ignition source.

As used herein, Hazardous Air Pollutant (HAP) is defined as those pollutants that are known or suspected to cause adverse environmental effects. This definition includes those compounds or elements identified by the EPA.

As used herein, Flare Assist Fluid is defined as a smoke suppressing medium that is added to the flare gas stream in order to achieve a smokeless, or essentially smokeless, operation. Flare Assist Fluids may include, but are not limited to, steam or air.

As used herein, the term "combustion efficiency requirement" is defined as greater than 98% conversion of organic compounds to carbon dioxide.

As used herein, the minimum net heating value may be a particular value, values, or range of values specified by a relevant statute. The minimum heating value may be about 270 Btu/SCF measured at the flare tip. The minimum heating value may be at least about 270 Btu/SCF to about 350 Btu/SCF measured at the flare tip. The minimum heating value may be at least about 270 Btu/SCF to about 300 Btu/SCF measured at the flare tip. The minimum heating value may be less than about 500 Btu/SCF measured at the flare tip. The minimum heating value may be less than about 400 Btu/SCF measured at the flare tip.

The Federal regulations specify that the minimum exit velocity and or net heating value be determined at the flare tip, depending on the type of process and materials to be flared. With few exceptions, measurement and recording of these parameters requires either a Continuous Emissions Monitoring System (CEMS) or a Predictive Emissions Monitoring System (PEMS) is employed. A CEMS directly measures, records and reports on the flare gas stream in real time, as close to the flare tip as possible. A PEMS uses surrogate parameters, typically farther upstream, to calculate and estimate the required parameters and are used when flow rates and composition are generally well documented and predictable. The PEMS may be used as an alternative to a CEMS where approved by permitting authorities.

In one embodiment of the present invention, a temporary and/or portable based supplemental fuel gas supply is supplied for the duration of a project. This can vary from readily available tanker refill support for onsite stationary storage tanks to fully temporary systems for supply and delivery of supplemental fuel gas. Depending on the application, this supplemental fuel gas can be provided via portable gas vessels (Cylinders, Liquid Vessels, Tubes, Micro-Bulk or Bulk), skid-based systems or truck/trailer mounted supply. This basic form could also be a simple as an external source of gas with limited capacity used simply to "spike" NHV at the initiation of a flare flow event.

In another embodiment of the present invention data input may be input into control system operation. This could be as basic as initiating (for example) supplemental gas feed on receipt of a signal noting that a nitrogen heater has been activated indicating the start of a hot nitrogen sweep.

High level support would include automatically controlled feed of supplemental fuel gas based on use of direct compositional or calorimetric monitoring of the flare gas stream and/or use of nitrogen flow information to proportionally control the amount of supplemental fuel gas fed into a line or lines. On/off control could also be tied to LEL detection or other device providing information based control.

The present invention may provide a temporary and/or portable connected source of supplemental fuel gas to elevate a flare stream BTU NHV to a level which meets plant and/or regulatory compliance requirements for combustion. A system as noted above with auto-actuation of flow based on some external device or controller. Either system discussed above with automatically controlled feed of supplemental fuel gas based on control data including, but not limited to, flow, pressure, direct read of flare line or flare tip NHV, LEL data or some other source of process and/or measurement information.

Turning now to the sole FIGURE, a method for controlling the Btu content of a flare gas is provided. In a first operating scenario, the initial Btu content 106 of the first gas stream 103 has a value greater than a predetermined minimum net heating value. In such an operating condition, no supplemental fuel 104 will be needed, and the first gas stream 103 may be sent to the flare 101 as it is.

In a second operating scenario one of the following three conditions has been met by the first gas stream. Either the hazardous air pollutants (HAP) level 114 is less than 20 ppm The pressure 108 is below 5 psig Btu/SCF. Or the lower explosive limit (LEL) 115 is less than 10%. In such an operating condition, no supplemental fuel 104 will be needed, and the first gas stream 103 may be sent to flare 101 as it is.

However, in a third operating scenario, the initial Btu content 106 falls below a threshold minimum net heating value 107 measured at the flare tip 102. In such as scenario the following method is initiated. The threshold minimum net heating value may be 300 Btu/SCF. The threshold minimum net heating value may be 270 Btu/SCF.

A first gas stream 103 to be flared, comprising nitrogen is provided. The first gas stream 103 has an initial Btu content 106. A supplemental fuel gas stream 104 is provided and combined with the first gas at a combination point 111, thereby obtaining a flare gas stream 105. The flare 101 may be equipped with an assist fluid 112. The flare gas stream 105 has a final Btu content 107 measured at the flare tip 102, after the addition of any assist fluid 112. The first gas stream 103 initial Btu content may be measured upstream of the combination point 111.

In one embodiment of the present invention, the predetermined minimum net heating value may be the minimum heating value required to achieve combustion efficiency requirements.

In one embodiment of the present invention, a feed-forward type operating mode is utilized. In this mode the first gas stream 103 has a first flow rate 109, wherein the first flow rate 109 is measured. The first flow rate 109 may be measured by any means know to the art. The supplemental fuel gas stream 104 has a second flow rate 110, wherein the second flow rate 110 is measured. The first flow rate 109 and the second flow rate 110 may be measured by any means know to the art. The ratio of the second flow rate 110 to the first flow rate 109 is maintained at, or above, a predetermined value. Since the first flow rate 109 is typically outside of the control of this system, it is the second flow rate 110 that is modulated to maintain the flow rate ratio.

This flow rate ratio may be calculated based on the measured first gas stream flow rate 109, and the known heating value of that particular stream. This flow rate ratio may be calculated based on the measured first gas stream flow rate 109, and the measured heating value, the initial Btu content, of the first gas stream 106. The flow rate of the supplemental fuel gas stream 104 is adjusted by control valve 113. This flow rate ratio allows the final Btu content 107 to be maintained at or above a minimum net heating value measured at the flare tip 102. The minimum net heating value may be 270 Btu/SCF measured at the flare tip 102.

In another embodiment, a feed-back type operating mode is utilized. In this mode the first gas stream 103 has a first flow rate 109, wherein the first flow rate 109 and the initial Btu content 106 are measured. The supplemental fuel gas 104 has a second flow rate 110, wherein the second flow rate 110 is measured and the final Btu content 107 is measured at the flare tip 102. The first flow rate 109 and the second flow rate 110 may be measured by any means know to the art. The flow rate of the supplemental fuel gas stream 104 is adjusted by control valve 113. The second flow rate 110 is adjusted to maintain the final Btu content 107 at or above a minimum net heating value at the flare tip 102.

The frequency with which flow rates and the Btu contents may be measured and reported may be dependent upon the measurement type that is chosen, or the overall requirements of the processing system. For example, if a gas chromatograph or a calorimeter is used, it is possible that only one Btu measurement may be possible within the target 15 minute time period. If, however, a mass spectrometer is employed, the Btu content may be measured and reported many times in the target 15 minute period. The flow rates and the Btu contents may be measured and reported at least every 15 minutes.

The supplemental fuel gas stream may be provided by a local, external bulk source 111. The bulk source 111 may be portable and temporary. The supplemental fuel 104 may be hydrogen, ethane, propane, propylene, butane and/or any suitable hydrocarbon with a sufficient heating value.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for controlling the Btu content of a flare gas to be combusted in a flare stack comprising a flare tip, the method comprising:

introducing a first gas stream comprising nitrogen to be flared, the first gas stream comprising an initial Btu content, providing a supplemental fuel gas stream, and combining the first gas stream with the supplemental fuel gas stream, thereby obtaining a flare gas stream comprising a final Btu content measured at the flare tip, wherein:

the first gas stream has a first flow rate, wherein the first flow rate is measured;

the supplemental fuel gas has a second flow rate, wherein the second flow rate is measured;

the ratio of the second flow rate to the first flow rate is maintained at a predetermined value, thereby maintaining the final Btu content at or above a minimum net heating value measured at the flare tip, wherein the first gas stream and the supplemental fuel gas stream are combined at a combination point, and wherein the first flow rate and the initial Btu content are measured upstream of the combination point.

2. The method of claim 1, wherein the supplemental fuel gas flow is initiated when the initial Btu content falls below a predetermined minimum net heating value measured at the flare tip.

3. The method of claim 2, wherein the predetermined minimum net heating value comprises the heating value required to achieve combustion efficiency requirements.

4. The method of claim 1, wherein the first gas stream has a pressure, and wherein the supplemental fuel gas flow is terminated when at least one of the following conditions has been met by the first gas stream:

the hazardous air pollutants (HAP) level is less than 20 ppm, the pressure is below 5 psig, or the lower explosive limit (LEL) is less than 10%.

5. The method of claim 1, wherein the predetermined value of the ratio of the flow rates is a function of the first flow rate and the initial Btu content.

6. The method of claim 5, wherein the first flow rate, the initial Btu content, and the final Btu content are measured and reported at least every 15 minutes.

7. The method of claim 6, wherein the Btu measurements are performed by a gas chromatograph, mass spectrometer, or calorimeter.

8. The method of claim 1, wherein the minimum net heating value is 270 Btu/SCF measured at the flare tip.

9. The method of claim 1, wherein the supplemental fuel gas stream is provided by a local, external bulk source.

10. The method of claim 9, wherein the local, external bulk source is portable and temporary.

11. The method of claim 10, wherein the supplemental fuel gas is selected from the group consisting of hydrogen, ethane, propane, propylene, butane and/or any suitable hydrocarbon with a sufficient heating value.

12. The method of claim 1, wherein:

the first gas stream has a first flow rate, wherein the first flow rate and the initial Btu content are measured;

the supplemental fuel gas has a second flow rate, wherein the second flow rate is measured and the final Btu content is measured at the flare tip; and wherein the second flow rate is adjusted to maintain the final Btu content at or above a minimum net heating value at the flare tip.

13. The method of claim 12, wherein the first flow rate, the initial Btu content, and the final Btu content are measured at least every 15 minutes.

14. The method of claim 12, wherein the minimum net heating value is 270 Btu/SCF measured at the flare tip.

15. The method of claim 12, wherein the supplemental fuel gas stream is provided by a local, external bulk source.

16. The method of claim 15, wherein the local, external bulk source is portable and temporary.

17. The method of claim 15, wherein the supplemental fuel gas is selected from the group consisting of hydrogen, ethane, propane, propylene, butane and/or any suitable hydrocarbon with a sufficient heating value.

* * * * *